United States Patent [19]

Graf et al.

[11] 4,005,302

[45] Jan. 25, 1977

[54] INDUCTIVELY HEATED DRAWROLL

[75] Inventors: Felix Graf, Winterthur; Armin Wirz, Dietlikon, both of Switzerland

[73] Assignee: Rieter Machine Works, Ltd., Winterthur, Switzerland

[22] Filed: Oct. 24, 1974

[21] Appl. No.: 517,587

[30] Foreign Application Priority Data

Nov. 2, 1973 Switzerland ..... 15429/73

[52] U.S. Cl. ..... 219/10.61; 28/62; 219/10.49; 219/10.79; 219/469

[51] Int. Cl.[2] ..... H05B 5/00; H05B 3/02; D02J 13/00

[58] Field of Search ..... 219/10.61, 10.61 A, 219/10.49, 10.49 A, 10.79, 469–471; 28/61, 62; 57/34 HS

[56] References Cited

UNITED STATES PATENTS

| | | | |
|---|---|---|---|
| 2,273,423 | 2/1942 | Somes | 219/10.49 A |
| 3,412,229 | 11/1968 | Seagrave | 219/469 X |
| 3,601,968 | 8/1971 | Wirz | 219/10.61 A |
| 3,761,666 | 9/1973 | Graf et al. | 219/10.61 A |
| 3,772,492 | 11/1973 | Brogden et al. | 219/10.61 A |

FOREIGN PATENTS OR APPLICATIONS

| | | | |
|---|---|---|---|
| 1,172,586 | 12/1969 | United Kingdom | 219/469 |
| 1,172,587 | 12/1969 | United Kingdom | 219/10.61 A |
| 244,289 | 5/1969 | U.S.S.R. | 219/10.49 A |

*Primary Examiner*—A. Bartis
*Attorney, Agent, or Firm*—Kenyon & Kenyon Reilly Carr & Chapin

[57] ABSTRACT

A heatable drawroll for drawtwisting, draw-winding and spin-draw winding machines includes a stationary induction heating coil having a core and mounted within rotatable metal jacket. A sleeve of heat and electrical insulating material is stationarily disposed inside the jacket in radially spaced relation to the jacket and the coil to circumferentially surround the coil and form an intermediate space therewith for receiving a coolant for cooling the coil. Means are provided for supplying coolant to and removing coolant from the intermediate space. A second coolant space can also be formed between the coil and the core and be connected with the first space via coolant ducts through the coil. The sleeve may be porous so as to allow some of the coolant to flow therethrough and impinge on the inner surface of the jacket.

10 Claims, 4 Drawing Figures

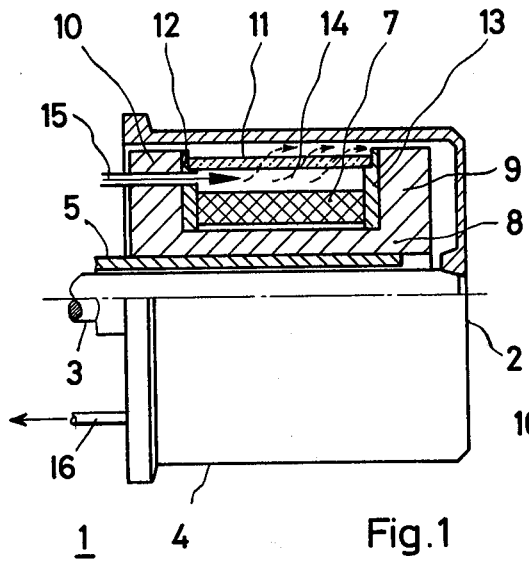
Fig. 1
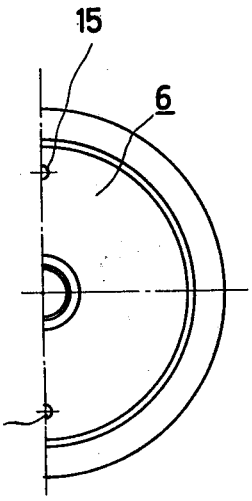
Fig. 2
Fig. 3
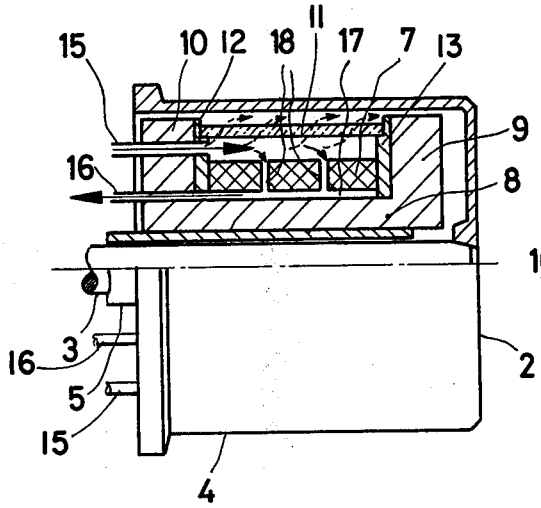
Fig. 4
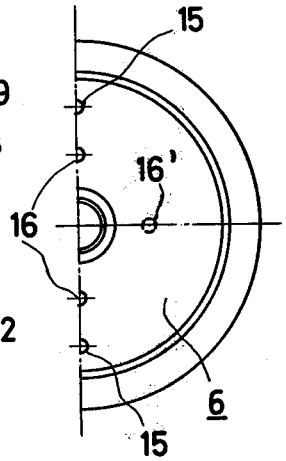

INDUCTIVELY HEATED DRAWROLL

This invention relates to a heatable drawroll and particularly to a drawroll for a draw-winding, draw-twisting or spin-draw-winding machine.

Drawrolls for various types of yarn treating machines have been known particularly those of the type described in U.S. Pat. No. 3,632,947 with inductively heatable roll jackets or sleeves. In such drawrolls, the power take-up and, thus, also the production capacity are severely limited by the heating-up of the induction coil as the current passes through. This is due to the Ohm resistance causing energy losses and by the maximum admissible coil temperature. The maximum admissable coil temperature, in turn, as a rule, is determined by the maximum admissable temperature for the conductor insulation and furthermore, the power take-up of the inductive heating device is limited by the space conditions available inside the drawrolls.

U.S. Pat. No. 2,273,423 describes an electrically heatable hollow roll for unspecified applications which comprises a hollow induction coil mounted on a stationary support member inside the roll, the coils of which can be cooled by cooling coils placed on the cylindrical outer surface of the coil. Such coil arrangements doubtlessly could be suitable for rolls of relatively large dimensions, such as e.g. calender rolls for the paper industry. However, as the dimensions of drawrolls for processing endless filaments in the fiber industry are considerably smaller and as the room inside a roll jacket is correspondingly smaller, coolable coils according to U.S. Pat. No. 2,273,423 cannot be practically applied to drawrolls without relatively complicated and correspondingly expensive additional devices, such as e.g. downwards transformers or HG generators. Thus, such a hollow roll is utterly unsuitable as a draw roll for draw-twisting, draw-winding or spin-draw-winding machines.

Accordingly, it is an object of the invention to achieve an increased power take-up of an inductive roll heating device and, thus, also an increased production capacity of the drawroll without substantially changing the drawroll dimensions or complicating the drawroll construction.

Briefly, the invention provides a heatable drawroll having a rotatable jacket or sleeve and a stationary inductive heating means mounted inside the jacket for heating the jacket with a coolable inductive coil.

In one embodiment, a sleeve is disposed in radially spaced relation to the coil to circumferentially surround the coil and form an intermediate space therewith for receiving a coolant. In addition, the sleeve which is made of heat insulating material is mounted on a pair of discs of heat and electrical insulating material. The discs, in turn, are mounted at respective ends of the coil. In order to cool the coil, a means is provided to supply and remove coolant to and from the space between the sleeve and coil. This means includes a supply duct which passes through a supply opening in one of the discs and a drain duct which passes through a drain opening in the same or other disc. The ducts are connected to a suitable coolant supply means.

In another embodiment, a second space is formed for coolant. This space is located between the coil and a core about which the coil is mounted. As above, this space communicates with a supply duct and a drain duct for coolant. Alternatively, radial ducts can be formed in the coil to communicate the two coolant spaces with each other. Also, two or more supply ducts can be connected to the spaces along with two or more drain ducts. The ducts may also be circumferentially offset from each other.

These and other objects and advantages of the invention will become more apparent from the following detailed description and appended claims taken in conjunction with the accompanying drawings in which:

FIG. 1 illustrates a partial longitudinal sectional view of a drawroll according to the invention;

FIG. 2 illustrates an axial view of the drawroll according to FIG. 1 as seen from the machine frame;

FIG. 3 illustrates a partial longitudinal section of a modified drawroll according to the invention; and FIG. 4 illustrates an axial view of the drawroll according to FIG. 3 as seen from the machine frame.

Referring to FIG. 1, a drawroll 1 is formed as a hollow cylinder to form a sleeve or jacket 4 with a cylindrical outer surface used as a thread support surface and a closed face side 2. This hollow cylinder is connected to the end of a drive shaft 3 which is rotatably supported in a machine frame (not shown) e.g. of a draw-twisting, draw-winding or spin-draw-winding machine. The cylindrical roll sleeve 4 is heated in a known manner by an inductive heating means 6 mounted inside the hollow cylinder on a suitable stationary support member 5. This heating means 6 substantially comprises coils 7 and a magnetically conductive iron core 8 with a flange 9, 10 at each end. The flanges 9, 10 extend radially towards the outside into close vicinity of the inside surface of the roll jacket 4 and together with the roll jacket 4 form a magnetic induction circuit, in which an alternating field is generated as the coil 7 is connected to any source of alternating current (not shown) in such a manner that the roll jacket 4 is heated.

As shown in FIGS. 1 and 2, the coils 7 of the induction heating means 6 are circumferentially surrounded over at least substantially their full length by a sleeve 11 made preferably from a heat and electrical-insulating material. The sleeve 11 suitably extends over the whole circumference and is stationarily disposed in radially spaced relation to the inside surface of the roll jacket 4. The sleeve 11 is also supported at both coil ends each by heat and electrical insulating discs 12, 13.

As opposed to the constructions known thus far, the insulating sleeve 11 of the drawroll is also disposed in radially spaced relation to the sleeve surface of the coils 7 and substantially concentrically with the coil axis. Both coil ends may also be supported by another suitable arrangement than the discs 12, 13 but in such a manner that a further intermediate space 14 is formed. This space 14 is closed on at least one face side or preferably is closed on both face sides and is substantially concentric to the coil axis. The intermediate space 14 is used for taking-up a coolant or for permitting a throughflow of a coolant for the coils 7. For this purpose, at least one supply duct 15 for a preferably gaseous coolant is inserted through the inductor flange 10 facing the machine frame via an opening and through the insulating disc 12. The duct 15 is connected to a suitable coolant supply means (not shown) so that the coolant flows into the intermediate space 14 to cool the coils 7. In order to drain the heated coolant, at least one outlet duct 16 is provided on the side opposite the supply duct 15 (FIG. 2) e.g. also penetrating the flange 10 via an opening and the insulating disc 12.

Referring to FIGS. 3 and 4, in which identical elements are designated with the same reference numbers, in addition to the outer intermediate space 14 an intermediate space 17, to which coolant can be supplied, is arranged concentrically with the drawroll axis between the iron core 8 and the coils 7. Furthermore, the outer space 14 can be connected with the inner space 17 via radially extending cooling ducts 18 in such manner that the cooling of the coils 7 is improved. In this arrangement, the coils 7 may be formed by spaced apart part-coils. Also, as shown in FIG. 4, two coolant supply ducts 15 can be placed opposite to each other offset by an angle of about 90° along with two draining ducts 16, also placed opposite each other. Furthermore, an insulating sleeve 11 of a certain porosity or permeability to the gaseous coolant so as to allow a small fraction of the coolant to flow through the sleeve 11 and impinge on the inner surface of the jacket 4 can be chosen without exceeding the scope of the invention.

The main advantages of the present invention reside in the increased power take-up capacity of the coils and in the increased heating power resulting therefrom. This, in turn, ensures against a substantially increased production capacity of the drawroll. In view of the usual power taken up, particularly by the heating devices of drawrolls of machines for processing endless filaments ranging about from 5 to 10 kW, the induction coil of the inventive roll can be directly connected to any regular low-tension supply network of e.g. 220/380 V.

What is claimed is:

1. A heatable drawroll for drawtwisting, draw-winding and spin-draw winding machines comprising
   a rotatable jacket,
   a stationary inductive heating means mounted inside said jacket for heating said jacket, said heating means including a coolable induction coil,
   a sleeve of heat and electrically insulating material stationarily disposed inside said jacket in radially spaced relation to said jacket and said coil to circumferentially surround said coil and form an intermediate space therewith for receiving a coolant, and
   means for supplying coolant to and removing coolant from said space.

2. A heatable drawroll as set forth in claim 1 wherein said sleeve further comprises a pair of discs of heat and electrical insulating material, each said disc being disposed at a respective end of said sleeve in supporting relation, at least one of said discs having a supply opening for the introduction of coolant into said space and at least one of said discs having a drain opening for removal of coolant, said sleeve and said discs defining together with said coil said intermediate space.

3. A heatable drawroll as set forth in claim 1 wherein said means supplies a gaseous coolant and said sleeve is permeable to the gaseous coolant to allow a small fraction of the coolant to flow through said sleeve and impinge on an inner surface of said jacket.

4. A heatable drawroll as set forth in claim 1 wherein said heating means further includes an induction core within said coil, said core and coil being disposed in radially spaced relation to define a second space for coolant therebetween said coolant supply and removing means supplying coolant to and removing coolant from said second space.

5. A heatable drawroll as set forth in claim 4 further comprising a plurality of cooling ducts passing through said coil to communicate said spaces with each other.

6. A heatable drawroll as set forth in claim 4 wherein said coil includes a plurality of axially spaced apart part-coils forming cooling ducts to communicate said spaces with each other.

7. A heatable drawroll for draw-twisting, draw-winding and spin-draw-winding machines comprising
   a rotatable drive shaft,
   a jacket secured to said shaft for rotation,
   a stationary heating means within said jacket including a magnetically conductive core and a plurality of induction coils about said core,
   a sleeve of heat and electrical insulating material stationarily disposed within said jacket in radially spaced relation to said jacket and said coils to circumferentially surround said coils and form an intermediate space therewith,
   at least one supply duct extending through said heating means into said space for supplying a coolant thereto, and
   at least one drain opening extending through said heating means from said space for draining coolant therefrom.

8. A heatable drawroll for heating a travelling yarn comprising
   a rotatable jacket;
   a stationary inductive heating means mounted inside said jacket for heating said jacket, said heating means including an induction coil, an annular space disposed about said coil, a sleeve of heat and electrical insulating material disposed inside said jacket in radially spaced relation to said jacket and said coil and a pair of discs of heat and electrical insulating material, each disc supporting a respective end of said sleeve at a respective end of said coil, said sleeve and said discs defining together with said coil said annular space; and
   means for supplying and removing coolant to and from said space to cool said coil.

9. A heatable drawroll as set forth in claim 8 wherein said means for supplying and removing coolant includes at least one duct in one of said discs for supplying coolant and at least one duct in one of said discs for removing coolant, said ducts being disposed in circumferentially offset relation to each other.

10. In combination with a machine for treating yarn; a heatable drawroll including a rotatable jacket, a stationary inductive heating means within said jacket for heating said jacket, said heating means including an induction coil, means for supplying coolant to said coil, a sleeve of heat and electrical insulating material disposed inside said jacket in radially spaced relation to said jacket and said coil to circumferentially surround said coil and form an intermediate space therewith for receiving a coolant and means for supplying coolant to and removing coolant from said intermediate space.

* * * * *